US009926755B2

(12) United States Patent
Van Petegem et al.

(10) Patent No.: US 9,926,755 B2
(45) Date of Patent: Mar. 27, 2018

(54) SUBSTANTIALLY DEGRADABLE PERFORATING GUN TECHNIQUE

(71) Applicant: Schlumberger Technology Corporation, Sugar Land, TX (US)

(72) Inventors: Charles Van Petegem, Sugar Land, TX (US); Aleksey Barykin, Pearland, TX (US); Philip Kokel, Houston, TX (US); Michael J. Bertoja, Bellaire, TX (US); Juan Pablo Guerra, Valencia (VE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 5 days.

(21) Appl. No.: 14/888,847

(22) PCT Filed: May 2, 2014

(86) PCT No.: PCT/US2014/036557

§ 371 (c)(1),
(2) Date: Nov. 3, 2015

(87) PCT Pub. No.: WO2014/179676

PCT Pub. Date: Nov. 6, 2014

(65) Prior Publication Data

US 2016/0076326 A1 Mar. 17, 2016

Related U.S. Application Data

(60) Provisional application No. 61/819,179, filed on May 3, 2013, provisional application No. 61/828,950, filed on May 30, 2013.

(51) Int. Cl.
*E21B 23/14* (2006.01)
*E21B 43/117* (2006.01)
(Continued)

(52) U.S. Cl.
CPC ..... *E21B 23/14* (2013.01); *E21B 7/04* (2013.01); *E21B 41/005* (2013.01); *E21B 43/116* (2013.01); *E21B 43/117* (2013.01)

(58) Field of Classification Search
CPC ..... E21B 43/116; E21B 23/14; E21B 41/005; E21B 43/117; E21B 7/04
See application file for complete search history.

(56) References Cited

U.S. PATENT DOCUMENTS 2,691,459 A * 10/1954 Whitmore ..... E21B 43/116 137/68.13
3,688,849 A * 9/1972 Briggs, Jr. ..... E21B 43/116 166/100

(Continued)

FOREIGN PATENT DOCUMENTS

WO 9850678 A1 11/1998
WO 9946476 A1 9/1999

(Continued)

OTHER PUBLICATIONS

International Search Report and the Written Opinion for International Application No. PCT/US2014/036557 dated Sep. 5, 2014.

(Continued)

*Primary Examiner* — James G Sayre

(57) ABSTRACT

A perforating gun technique. The technique includes perforating with the gun in a manner that deforms internal support structure thereof. Thus, follow-on treatment with a breakup fluid tailored to the material of the support structure may be utilized to dissolve the structure. The carrier of the gun which houses the structure may then be utilized as a conduit for fluid flow.

20 Claims, 6 Drawing Sheets

(51) Int. Cl.

| | |
|---|---|
| ***E21B 7/04*** | (2006.01) |
| ***E21B 41/00*** | (2006.01) |
| ***E21B 43/116*** | (2006.01) |

(56) References Cited

U.S. PATENT DOCUMENTS

| | | | | |
|---|---|---|---|---|
| 4,467,878 | A * | 8/1984 | Ibsen | E21B 43/117 175/4.59 |
| 5,223,664 | A | 6/1993 | Rogers | |
| 5,660,232 | A | 8/1997 | Reinhardt | |
| 5,829,538 | A | 11/1998 | Wesson et al. | |
| 6,009,947 | A | 1/2000 | Wilson et al. | |
| 6,062,310 | A * | 5/2000 | Wesson | E21B 43/119 166/297 |
| 6,173,779 | B1 * | 1/2001 | Smith | E21B 43/116 166/242.6 |
| 6,220,370 | B1 * | 4/2001 | Wesson | E21B 43/116 102/320 |
| 6,289,991 | B1 | 9/2001 | French | |
| 6,386,288 | B1 | 5/2002 | Snider et al. | |
| 6,557,636 | B2 | 5/2003 | Cernocky et al. | |
| 6,962,202 | B2 | 11/2005 | Bell et al. | |
| 7,546,875 | B2 | 6/2009 | Whitsitt et al. | |
| 7,753,121 | B2 | 7/2010 | Whitsitt et al. | |
| 9,121,265 | B2 * | 9/2015 | Myers | E21B 43/116 |
| 2002/0189482 | A1 | 12/2002 | Kneisl et al. | |
| 2005/0061506 | A1 | 3/2005 | Grove et al. | |
| 2005/0157108 | A1 | 7/2005 | Silverbrook | |
| 2009/0114382 | A1 | 5/2009 | Grove et al. | |
| 2009/0151949 | A1 | 6/2009 | Marya et al. | |
| 2013/0087061 | A1 | 4/2013 | Marya et al. | |
| 2014/0034384 | A1 * | 2/2014 | Fadul | E21B 43/117 175/2 |

FOREIGN PATENT DOCUMENTS

| | | | |
|---|---|---|---|
| WO | 2013032991 | A2 | 3/2013 |
| WO | 2013033535 | A2 | 3/2013 |
| WO | 2014179676 | A1 | 11/2014 |

OTHER PUBLICATIONS

International Preliminary Report on Patentability issued in the related PCT application PCT/US2014/036557 dated Nov. 3, 2015 (6 pages).

EP search report issued in the related EP application 14791379.2, dated Oct. 21, 2016 (3 pages).

Communication Pursuant to Article 94(3) issued in the related EP Application 14791379.2, dated Nov. 17, 2016 (4 pages).

* cited by examiner

SUBSTANTIALLY DEGRADABLE PERFORATING GUN TECHNIQUE

PRIORITY CLAIM/CROSS REFERENCE TO RELATED APPLICATION(S)

This Patent Document claims priority under 35 U.S.C. §119 to U.S. Provisional App. Ser. No. 61/819,179, filed on May 3, 2013, and entitled, "Flow Through Gun with Integral Completion Equipment" and also to U.S. Provisional App. Ser. No. 61/828,950, filed on May 30, 2013, and entitled, "Flow Through Gun with Break-up Treatment", each of which are incorporated herein by reference in their entireties.

BACKGROUND

Exploring, drilling, and completing hydrocarbon wells are generally complicated, time consuming, and ultimately very expensive endeavors. As a result, over the years, well architecture has become more sophisticated where appropriate in order to help enhance access to underground hydrocarbon reserves. For example, as opposed to wells of limited depth, it is not uncommon to find offshore and certain other hydrocarbon wells exceeding 30,000 feet in depth. Furthermore, today's hydrocarbon wells often include deviated or horizontal sections aimed at targeting particular underground reserves. Indeed, at targeted formation locations, it is quite common for a host of lateral legs and perforations to stem from the main wellbore of the well toward a hydrocarbon reservoir into the surrounding formation.

The above described perforations are formed and effectively completed by a series of applications that begin with perforating the wellbore. So, for example, a casing defining the well may be perforated with use of a perforating gun. The gun itself may include a cylindrical carrier of stainless steel or other suitable material that houses a carrier tube equipped with conventional shaped charges. Thus, the shaped charges will be detonated with explosive forces therefrom directed out of the gun and toward the well wall and/or casing in order to form the noted perforations.

In many circumstances, the described perforating application takes place in conjunction with the installation of completions hardware in mind. For example, lower and upper completions hardware may be installed in the well with a barrier valve or other form of well control maintained therebetween. Thus, a subsequent intervention in the form of the noted perforating may present challenges to maintaining well control.

With this in mind, efforts have been undertaken to prevent loss of well control by the introduction of a perforating gun into a well. For example, breaching a barrier valve to run a perforating gun into the well may not be required in circumstances where the gun itself is installed in conjunction with the completions hardware. Thus, rather than an intervention trip into the well for the sake of perforating, the gun may already be in place when the time for perforating arrives.

Unfortunately, installing completions or other isolation-type hardware already outfitted with a perforating gun, means that once the perforating application is completed, a gun immediately adjacent to newly formed perforations is left in place. Thus, production flow from the perforations may be obstructed to a degree by the gun and associated hardware.

Nevertheless, in order to prevent the perforating gun from remaining an obstacle to efficient production, the architecture of the well may include a "rat hole" or tail at its terminal end where the gun itself may be discarded. So, for example, during drilling of the well, an additional unused well space may be drilled to receive the gun. Following the perforating application, the gun may be cut off or released into the tail so as to no longer present an obstruction to production from the newly formed perforations.

SUMMARY

Embodiments and techniques for utilizing perforating equipment are described. The perforating gun of the equipment may be deployed into a well where a perforating application is performed. The gun includes a tubular carrier device with internal explosive support system components. These components are at least partially deformed by the perforating application. A break-up treatment fluid within the well may then be used to degrade remaining deformed components of the system and leave the carrier device substantially free of such components. Thus, fluid may readily be flowed through the tubular carrier device. Such flowing may include producing hydrocarbons of the well through the carrier device which serves as production tubing.

DETAILED DESCRIPTION

Embodiments are described with reference to certain types of downhole perforating applications. For example, embodiments detailed herein are directed at completions equipment that incorporates a perforating gun. Thus, the gun may be located below flow-control hardware and serve as production tubing following perforating and break-up treatment that substantially eliminates internal support structure.

This may even include selective control over separate zonally isolated production regions. However, perforating applications that are not necessarily incorporated into completions hardware may also take advantage of the tools and techniques described herein. So long as internal support structure of a perforating gun is deformed by perforating and substantially degraded by follow on break-up treatment, appreciable benefit may be realized as the remaining tubular carrier of the gun is used to accommodate fluid flow.

Figure 1:
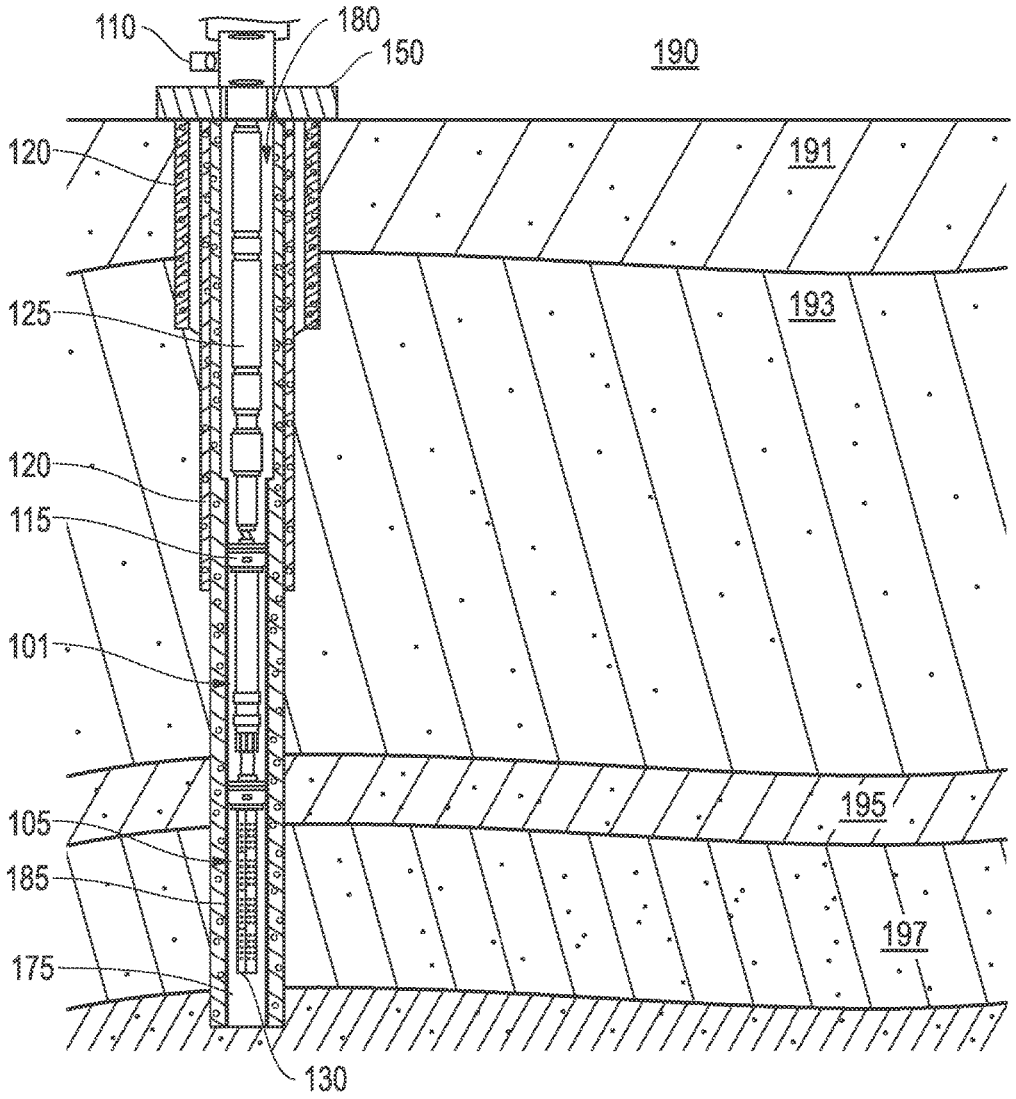
FIG. 1 is an overview of oilfield accommodating completions hardware with a perforating gun.

Referring now to FIG. 1, an overview of oilfield is shown with a well 180 accommodating completions hardware. In the embodiment shown, the lower completions hardware 101 of the system includes a perforating gun 105 that is integrally incorporated thereinto. Specifically, the gun 105 is also in direct tubular communication with upper completions production tubing 125 and includes a dissolvable internal support system as detailed further below. Thus, while initially serving as a perforating gun 105, this portion of the hardware may later serve as a conduit for fluid flow.

Utilizing completions hardware for the dual purposes of perforating and subsequent fluid flow as noted above may be of significant benefit to offshore operations as depicted in the embodiment of FIG. 1. For example, the oilfield of FIG. 1 is in an offshore environment with a well head 150 and pressure control equipment 110 mounted at a seabed. In addition to being located several hundred feet or more below water 190, completing the well 180 may require drilling several thousand feet further, past a variety of formation layers 191, 193, 195 before reaching a targeted production layer 197. Thus, even setting aside the added amount of time and expense dedicated to properly drilling, placing cement 120, installing casing 185, or delivering completions hardware, even the most time-efficient trip into or out of the well 180 may require a day or more of otherwise non-producing time. However, a dual purpose perforating gun 105, for perforating and subsequently accommodating fluid flow, may minimize time and expense in terms of both drilling and trips into the well 180.

The perforating gun 105 of FIG. 1 is shown installed as part of permanent completions hardware. That is, as opposed to installing lower completions hardware 101 without a gun 105 and later delivering a gun 105 on another trip into the well 180, the time dedicated to such a trip is saved and the perforating gun 105 is supplied at the same time the lower completions hardware 101 is installed. However, in addition to saving trip time dedicated to perforating, time and expense are also saved in terms of drilling. That is, as shown in FIG. 1, a terminal space 175 at the tail end of the well 180 extends beyond the terminal end 130 of the gun 105 by only a short distance. That is, as opposed to a more conventional "rat hole" extending 50-100 feet or more and taking two days or more to drill, the terminal space 175 of FIG. 1 may extend no more than 5-25 feet in depth beyond the terminal end 130 of the gun 105.

A rat hole space 175 such as this which is 70-80% smaller than convention is possible because the entire body of the gun 105 need not be accommodated therein following perforating. Instead, as noted above, the gun 105 is dual purpose and, rather than discarding into the terminal space 175 following perforating, may remain in place and serve as a structural conduit to accommodate fluid flow. Indeed, in the embodiment shown, the space 175 may be no deeper than about 25-30% of the length of the gun 105 itself.

In addition to saving time and expense in terms of drilling a longer "rat hole" or saving on trip time, utilizing a dual purpose perforating gun 105 as described, also leaves in place a structural conduit that may help to regulate fluid flow as noted. That is, as opposed allowing production fluids from newly formed perforations in the formation 197 to flow freely up ward, a structural support or guide is left in place in the form of the gun 105. Thus, as detailed below with reference to FIG. 5, a platform is left in place that may be utilized to regulate flow, for example, as conditions change in the future.

Figure 2D:
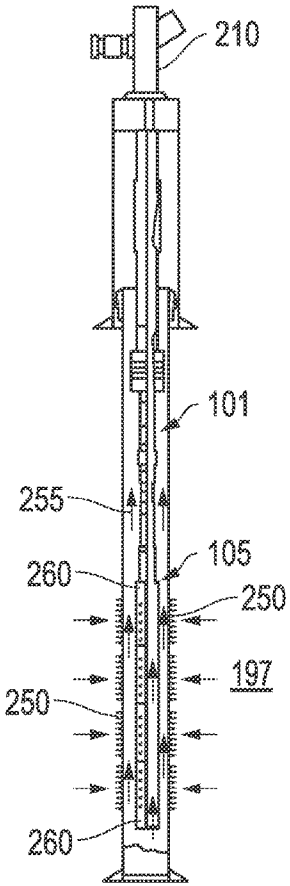
FIG. 2D is a side cross sectional view of the well at the oilfield of FIG. 1 upon producing through the gun of the completions hardware.
Figure 2C:
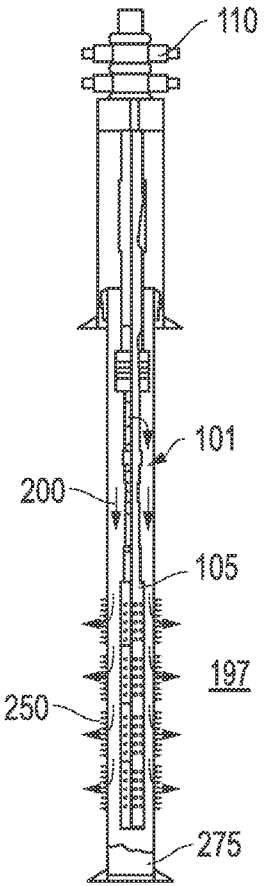
FIG. 2C is a side cross sectional view of the well at the oilfield of FIG. 1 following perforation with the gun of the completions hardware.
Figure 2B:
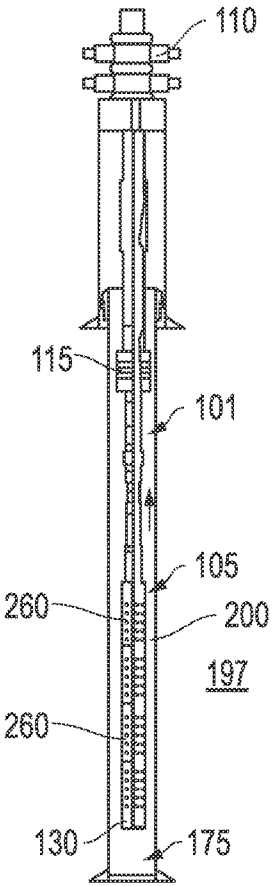
FIG. 2B is a side cross sectional view of the well at the oilfield of FIG. 1 following installation of the completions hardware.
Figure 2A:
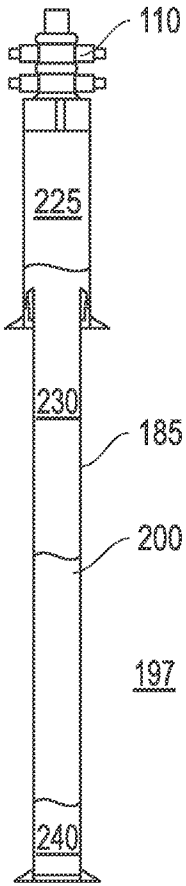
FIG. 2A is a side cross sectional view of a well at the oilfield of FIG. 1 prior to installation of the completions hardware.

Referring now to FIGS. 2A-2D, side cross sectional views of the well 180 of FIG. 1 are shown as an embodiment of installing, perforating and producing through a dual purpose perforating gun 105 are described. Specifically, FIG. 2A depicts the well 180 prior to installation and FIG. 2B shows the well 180 upon installation of the lower completion 101 with perforating gun 105. Thus, FIG. 2C reveals the gun 105 upon perforating, whereas FIG. 2D shows the gun 105 after perforating and supporting the uptake of production fluid from newly formed perforations 250 into the surrounding formation 197.

With specific reference to FIG. 2A, the well 180 is shown closer to the outset of completions operations. Specifically, initial drilling is completed and the casing 185 defining the well 180 is fully installed along with pressure control equipment 110. However, prior to finishing out upper and lower completion installation, the well 180 remains largely free of hardware. Instead, in the embodiment shown, different types of fluids 225, 230, 200, 240 may be spotted and/or maintained at certain locations within the well 180.

Fluids within the well 180 as shown include a break-up treatment fluid 200. With added reference to FIGS. 1 and 3A, this particular fluid 200 may be a treatment fluid or other suitable fluid type that is selected based on the material makeup of a dissolvable internal gun support structure 300 of the gun 105. That is, the fluid 200 may be selected based on the inherent ability to dissolve such structure 300 once it has been deformed during a perforating application as described further below. In the embodiment shown, the break-up treatment fluid 200 is located in advance of finishing out the completions installation. Of course, in other embodiments, this fluid 200 may be introduced at another appropriate time.

Continuing with reference to FIG. 2A, other types of fluids 225, 230, 240 may also be present in the well 180. For example, following drilling, the end of clean-out may include placing fluid downhole beginning at the bottom of the well 180. In this manner a clean barrier fluid 240 may be placed that is heavier than the treatment fluid-based treatment fluid 200, for example, to prevent treatment fluid 200 from penetrating the tail end of the well 180. Similarly, following placement of the treatment fluid 200, a spacer fluid 230 that may be a brine that is lighter than the treatment fluid 200 is placed above the treatment fluid 200. Lastly, a completion brine 225 that is still lighter may be placed that is tailored to safe interaction with upper completions hardware. Of course, more or fewer different types of fluids may be similarly utilized. For example, in an embodiment where concern over treatment fluid 200 penetrating into the tail end of the well 180 or interacting with completions fluid 225 is minimal, barrier 240 and spacer 230 fluids may be avoided altogether.

Referring specifically now to FIG. 2B, completions hardware is shown installed with the lower completion 101 including the above noted perforating gun 105. The gun 105 includes various carriers 260 that become submerged within the treatment fluid 200 described above. However, the gun 105 is also isolated from the surrounding fluid environment. For example, as described above, the terminal end 130 of the hardware is plugged. Thus, the treatment fluid 200 and other fluids are likely to be displaced in an uphole direction as the un-fired gun 130 and other portions of the lower completion 101 are located into position. While this displacement is accounted for when the treatment fluid 200 is originally placed, the lower completion 101 also includes a fluid isolating packer 115 as would normally be the circumstance. That is, full installation of the lower completion 101 inherently includes providing an isolating barrier to the uphole displacement of treatment fluid 200 into upper completions areas. Of course, intentional flow through the completions, and other seal testing may be undertaken to ensure that the completions are all in place and functional prior to any perforating via the gun 105.

Referring now to FIG. 2C, the well 180 is shown following a perforation application by the gun 105. As with a conventional perforation application, perforations 250 are formed into the formation 197. These perforations 250 emanate from the gun 105 generally but also, specifically from different carriers 260 of the gun 105. That is, in the embodiments shown herein, multiple carriers 260 have been strung together in sequence such that a longer perforated zone of the well 180 is formed by the perforating application. Once the perforating application takes place, ports of each carrier 260 are traversed by perforating jets which emerge from shaped charges 320 as described above and shown in FIG. 3A.

As also described in greater detail below with added reference to FIG. 3A, the internal support structure 300 which accommodates the shaped charges in advance of perforating is at least partially deformed by the perforating application. Indeed, even upon the initial perforating, a certain degree of broken component material 275 may be found deposited at the terminal space 175 at the bottom of the well 180. That is, the plug at the terminal end 130 of the gun 105 may be rendered ineffective by the explosive perforating application. Therefore, component material from this plug, or portions of the structure 300 that have been broken by the perforating may fall to the bottom of the well.

Figure 3A:
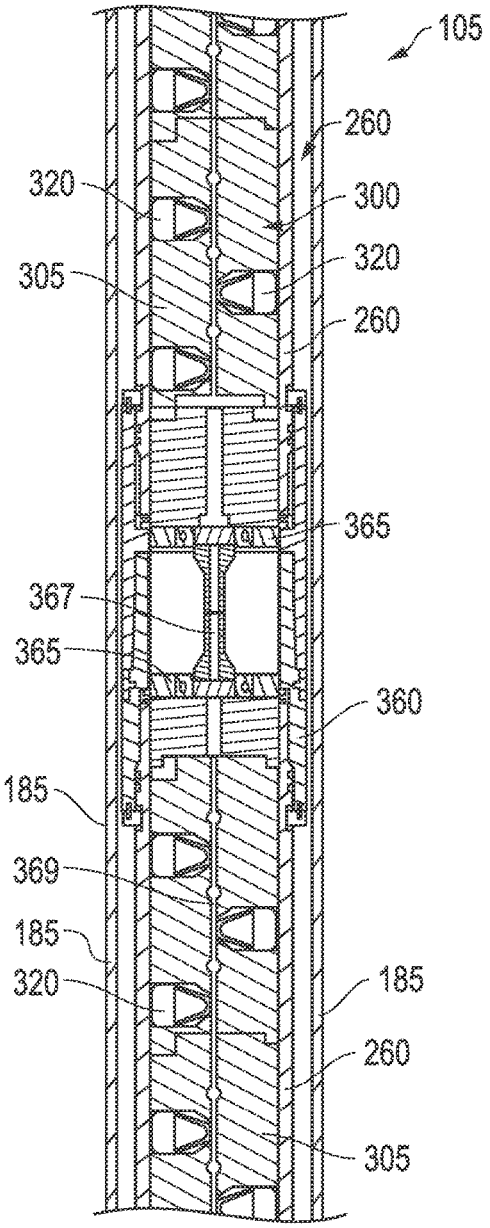
FIG. 3A is an enlarged cross-sectional view of the perforating gun of FIG. 1 prior to perforating.

Continuing with reference to FIG. 2C with added reference to FIG. 3A, while perforating fails to completely deteriorate all of the internal support structure 300, it may be left largely broken and substantially deformed with added amounts of exposed surface area. Thus, the treatment fluid 200 may begin to interact with the deformed structure 300 such that the amount of dissolved component material 275 increases over time. Additionally, in order to increase the amount and/or rate of dissolution of the remaining internal structure 300, additional treatment fluid 200 may be pumped downhole through the completion hardware and carriers 260. This may take place as part of standard fracing over the course of stimulation operations or as part of separately introduced mini-fracing applications. Regardless, in the embodiment shown, the additionally provided treatment fluid 200 is routed through the interior of the tubing of the upper and lower completion 101 before being allowed into the well space below the packer 115.

Where the treatment fluid 200 is an acid it may be heavier than hydrocarbons of the surrounding formation 197. Thus, for a period these fluids may mix and production largely prevented. However, eventually, the internal structure 300 will be substantially dissolved through this technique, dropping dissolved material 275 into the bottom of the well 180 and leaving carriers 260 linked together to serve as production tubing of the lower completion 101. Under-balanced fluids may then be pumped to displace the acid and allow the lower completion 101 to be brought online for production. Indeed, in many circumstances, the time taken to install the Christmas tree and bring the lower completion 101 online for production may be more than sufficient to substantially attain full degradation of the internal structure 300. In essence, perforating followed by a breakup treatment has transformed a perforating gun 105 into production tubing for the uptake of hydrocarbons from the surrounding formation 197.

With particular reference to FIG. 2D, production fluids 255 are shown emerging from perforations 250 into the formation 197 as alluded to above. A structural pathway, free of occluding internal structure 300 is provided in the form of linked together carriers 260 as detailed above (see FIG. 3A). Indeed, in the depiction of FIG. 2D, long term production lines 210 (i.e. a "Christmas Tree") are shown added to the wellhead to manage long-term flow and production.

Referring now to FIG. 3A, an enlarged cross-sectional view of the perforating gun 105 of FIG. 1 is shown prior to perforating. The gun 105 includes separate carriers 260 that are linked together by an adapter 360. Unlike the internal support structure 300, the carriers 260 and adapter 360 are of stainless steel or other more durable material that is not prone to dissolving or degrading upon exposure to treatment fluid 200 (see FIGS. 2A-2D).

Continuing with added reference to FIGS. 2A-2D, the internal support structure 300 on the other hand is made up of components 305, 365, 367 that are prone to dissolution upon exposure to treatment fluid 200. Specifically, these components may include a loading device 305, which may be a tube or tray for accommodating shaped charges 320. A booster support 367 to link together detonating cord 369 through each carrier 260 and loading 305 device is also shown along with securing plates 365. Of course, additional components such as a tube or tray adapter may also be provided as part of the support structure 300. Regardless, these components may all be dissolved through the combined explosive perforating and follow-on treatment application.

In one embodiment, the casing of the shaped charges 320 are of zinc or a powdered metal with the other components 305, 365, 367 being of a degradable plastic. Thus, following perforating, the detonating cord 369 and explosive of the shaped charge may be fully dissolved along with the noted casing. Though, in a circumstance where powdered metal or zinc is utilized, subsequent flow may take place after perforating to help ensure that the dissolved zinc component does not form a cement-like debris in character. However, at the same time, the loading device 305, booster support 367 and securing plate 365 may be left largely in place, though deformed, mangled and broken to a degree. Thus, the described follow-on breakup treatment and flowing through the gun 105 may be applied to fully dissolves such components 305, 367, 365.

Figure 3B:
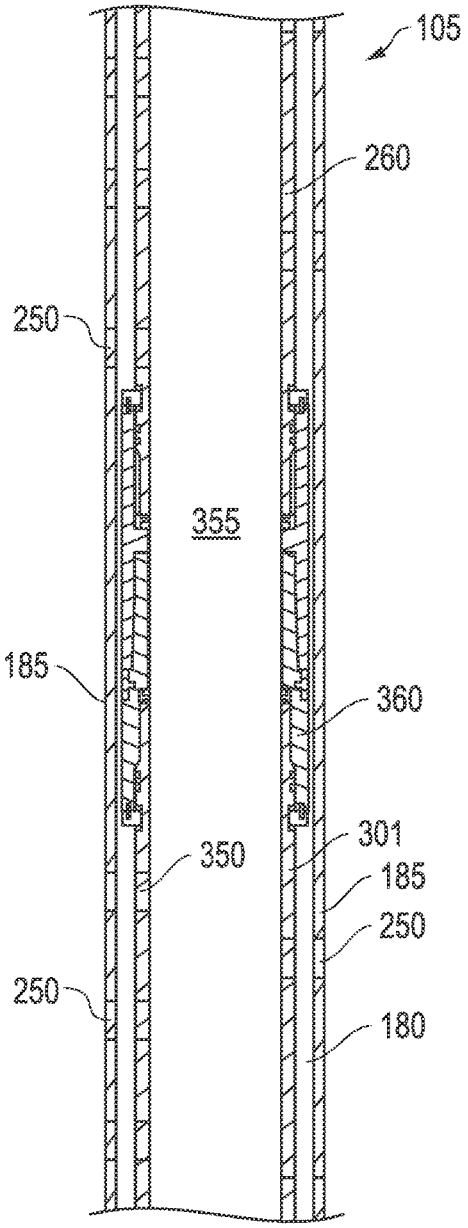
FIG. 3B is an enlarged cross-sectional view of the perforating gun of FIG. 3A following perforating and break-up treatment.

Referring now to FIG. 3B, the connected carriers 260 are shown after perforating and dissolution of the internal structure 300 of FIG. 3A via the noted breakup treatment. Thus, a substantially debris-free channel 355 is left that is defined by the carriers 260. Additionally, the perforating application has formed perforations 250 through the casing 185 as well as ports 350 through the carriers 260 that are aligned with the perforations 250. Thus, fluid in the well 180, whether treatment 200 or production 255 in nature, may be flowed into and out of the channel 355. With added reference to FIG. 1, this may include flowing through the terminal end 130 of the gun 105 where the internal plug is broken or sheared away upon perforating and may also undergo added dissolution during breakup treatment. Along these lines, a plug may also be located at the uphole end of the gun 105 prior to perforating that is broken and/or dissolved by the noted perforating and breakup treatment applications described above. In one embodiment, these plugs are of a dissolvable aluminum that is exposed to the treatment fluid upon the perforating.

Figure 4A:
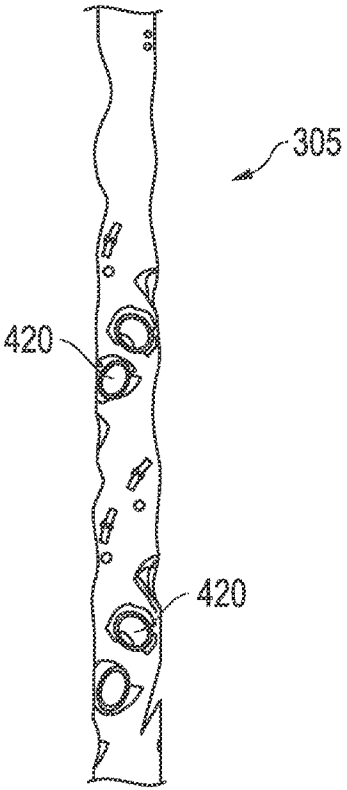
FIG. 4A is a side view of a loading tube of the gun of FIG. 3A following perforating and prior to perforating.

Referring now to FIG. 4A, a side view of the loading device 305 of FIG. 3A is shown following perforating and prior to breakup treatment. The loading device 305 is a loading tube. However, with added reference to FIG. 3A, a loading tray or other device type may be utilized to accommodate shaped charges 320 (e.g. at charge locations 420) prior to the perforating. The loading device 305 is partially broken and mangled as a natural result of the perforating application described above. Indeed, some portions of the device 305 may already be broken material 275 at the bottom of the well 180 (e.g. see FIG. 2C). The same may be true for plugs and other components of the internal support structure 300 of the gun 105 of FIG. 3A which may also include gun connectors, ballistic transfers, a firing head and or a host of other internal components.

The mangled, partially collapsed and broken loading tube 305 along with other components of the support structure 300 may be of added exposed surface area following the perforating. Along with material choice, this added exposure may enhance dissolution during the breakup treatment to follow. As to materials that may be utilized for the loading tube 305 and other internal components, aluminum, magnesium, zinc, plastics, polymers and/or composites thereof may be good candidates for durable, yet dissolvable construction. In one embodiment a plastic of polylactide, polyvinyl alcohol, or polyoxymethylene may be utilized. In another embodiment, a plastic foam of expanded polystyrene, expanded polypropylene, polyurethane, polymethacrylimide or polylactide is utilized.

Further, propellants or other additives may be incorporated into the selected material so as to enhance the breakup treatment reaction for sake of degradation. Additionally, minerals and other fillers may be incorporated into the base material to tailor strength and/or durability.

Figure 4B:
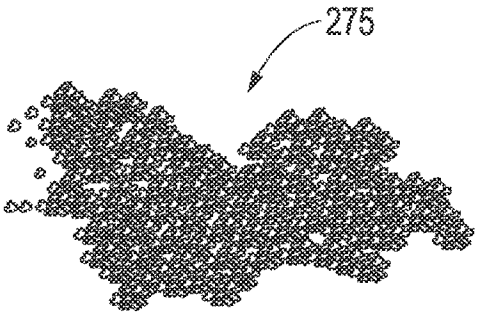
FIG. 4B is a side view of the material of the degraded loading tube of FIG. 4A following break-up treatment.

Referring now to FIG. 4B, a side view of the material 275 of the dissolved loading tube 305 of FIG. 4A is shown following break-up treatment. With added reference to FIG. 2C, this is the dissolved component material 275 described above at the bottom of the well 180. In one embodiment, the exposure to treatment fluid 200 which breaks up the loading tube 305 and other components into the dissolved material 275 takes place over less than, or substantially the same, period of time that it takes to move from perforating to producing in terms of setup at the oilfield. That is, in this embodiment the gun 105 may be left in place for the several hours it takes operators to change out surface equipment for sake of production. Over that time, breakup treatment may take place as the tube 305 and components are dissolved due to the exposure to the treatment fluid 200.

With added reference to FIGS. 2A-2D, the treatment fluid 200 itself may be selected based on the type of material chosen for the loading tube 305 and other components. The fluid 200 may include solids, liquid or gaseous substances mixed with a carrier fluid that is tailored to bring about a dissolving chemical reaction from the tube 305 and other components. The reaction itself may alter downhole conditions such as pressure and/or temperature to further enhance the breakup. Corrosives (acidic or alkali) may be utilized that are mixed with solvents and perhaps catalysts that further breakup reactions. Specific embodiments of the breakup fluid 200 may include polylactic acid, hydrogen chloride, or even a water based solution. Indeed, in one embodiment, exposure to brine of the well 180 may be sufficient to initiate and complete the breakup. That is, the treatment fluid 200 may be the well fluid that is already likely present within the well 180. Thus, separate spotted delivery of the fluid 200 is not required, only perforating to expose the structure 300 to well fluids.

Figure 5:
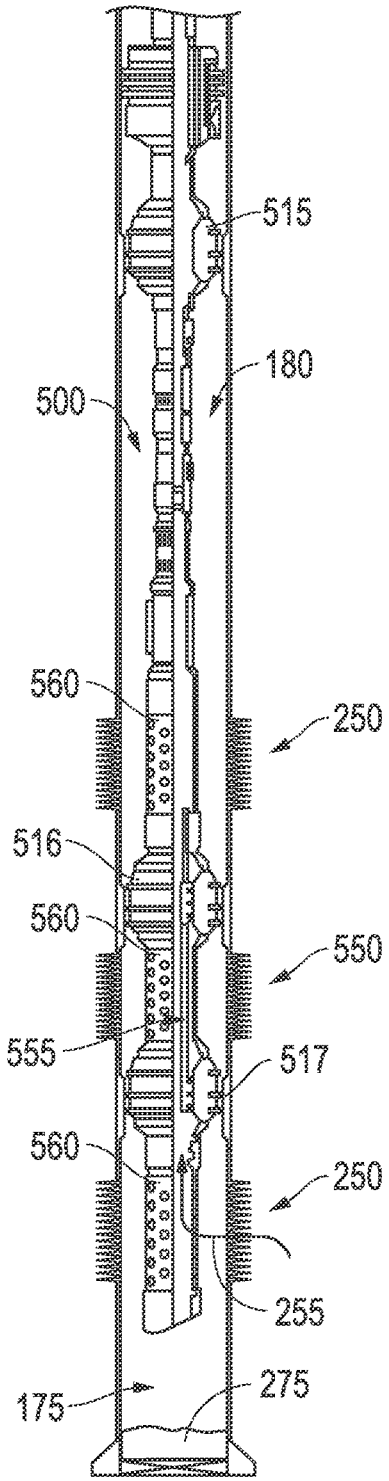
FIG. 5 is a partial cross-sectional view of a perforating gun after degradation of the internal support system.

Referring now to FIG. 5, a side cross-sectional view of an alternate embodiment of a perforating gun 500 is shown which also includes a dissolvable internal support system 300 such as that of FIG. 3A. In this case, the well 180 has already undergone perforating and the above described breakup treatment. Therefore, the support system 300 as shown in FIG. 3A is now only left as dissolved material 275 in the space 175 at the bottom of the well 180.

In the embodiment of FIG. 5, the hardware of the lower completion that encompasses the gun 500 is zonal in nature. That is, even below the seal stacker 515 that isolates the depicted lower completion, additional packers, seal stackers, or polished bore receptacles 516, 517 are shown. Thus, once these seal stackers 515, 516, 517 are all set and perforations 250, 550 formed, these different perforated regions may be isolated from one another. For example, in the embodiment shown, one set of perforations 550 may begin to produce water or display some other undesirable characteristic as it relates to production operations. Therefore, a blocking seal or sleeve 555 may be shifted or delivered into a position within the carrier device 560 that is between seal stackers 516, 517, and adjacent the undesirable perforations 550, to cease production therefrom. As a result, production fluids 255 will now be limited to emerging from adjacent desired perforations 250. Ultimately, a perforating gun 500 is provided that may become free of internal structure for sake of production and later zonally isolated in a targeted fashion for sake of production without a new run for setting of new packers.

Figure 6:
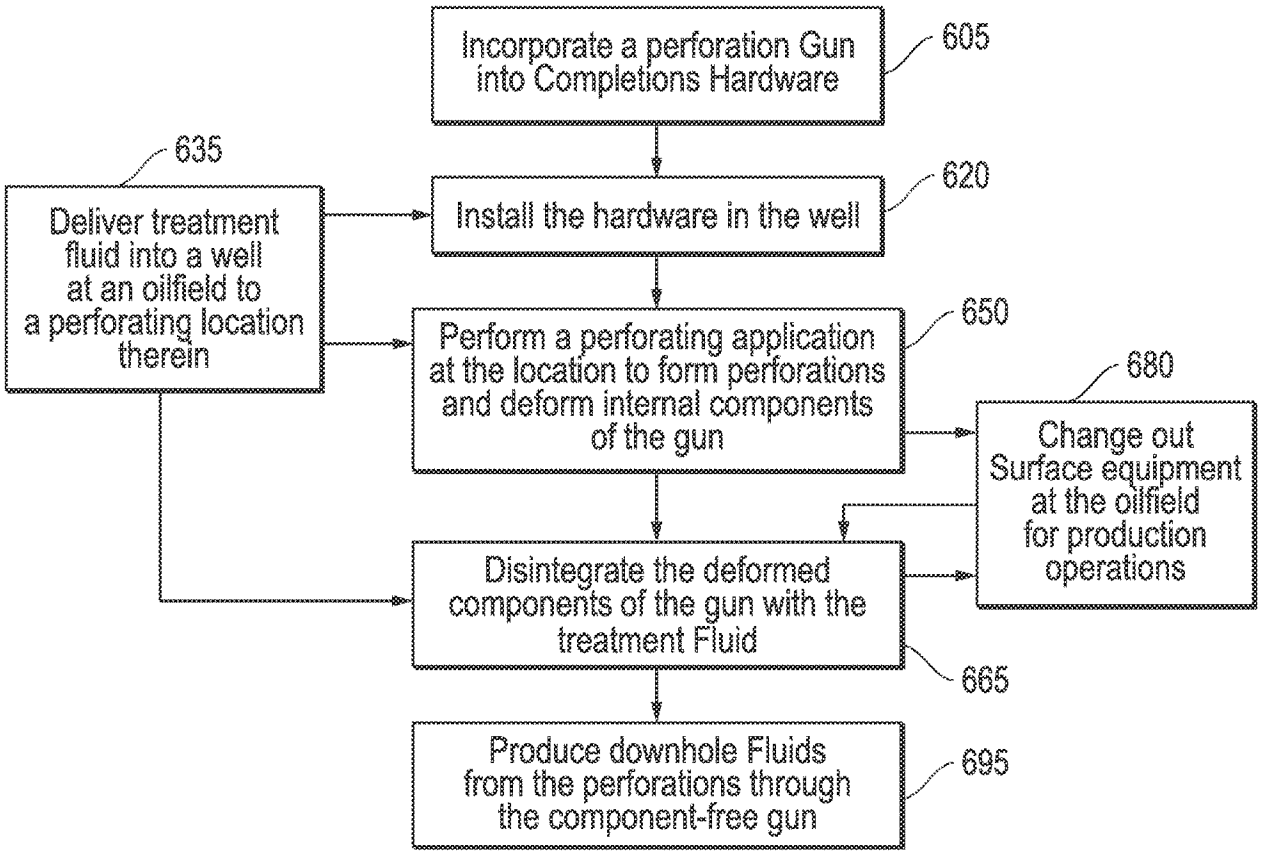
FIG. 6 is a flow-chart summarizing an embodiment of employing completions hardware with an embodiment of a perforating gun having a dissolving internal support system.

Referring now to FIG. 6, a flow-chart is shown summarizing an embodiment of employing completions hardware with an embodiment of a perforating gun having a degradable internal support system. As indicated at 605 and 620, the gun may be incorporated into completions hardware and installed in a well. Although, in other embodiments, the gun may be of a less permanent nature such as for a dedicated intervention. Regardless, as indicated at 650, the gun is utilized to both form perforations and deform the noted internal components of a support system that accommodates shaped charges for the perforating. At the same time, the gun is also exposed to a treatment fluid that may be delivered to the perforating location, whether before delivery of the gun, before the perforating, or even after (see 635).

With the deformed components of the gun now exposed to the treatment fluid due to the breach caused by the perforating, they may be dissolved by this fluid as noted at 665. At the same time, surface equipment may be changed out for sake of production operations as indicated at 680. In fact, in one embodiment the time required for dissolution is no more than the several hours required to complete such a change out. Thus, no added operation time is lost for sake of the treatment application. Once the dissolution is complete and the production equipment set, downhole fluids from the perforations may now be produced through the gun as indicated at 695. In fact, in one embodiment, this production may be zonally controlled by selectively closing off certain perforation regions as necessary (e.g. see FIG. 5).

Embodiments described hereinabove allow for the use of a perforating gun incorporated into completions hardware without the requirement of drilling an excessively long tail or rat hole for sake of gun disposal. Furthermore, internal components of the gun are durable enough to effectively withstand incorporation into such large scale equipment and undergoing an explosive perforating application. At the same time, however, such components are dissolvable following the perforation application such that production may effectively flow through the gun.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of using a perforating gun with a degradable internal support structure housed in a tubular carrier, the method comprising:

placing a break-up treatment fluid into a well at a predetermined location;

deploying the perforating gun into a well;

performing a perforating application in the well, said performing at least partially deforming components of the support system;

allowing sufficient time for the break-up treatment fluid in the well to dissolve remaining components of the support system and leave the carrier substantially free therefrom; and flowing a fluid through the component-free tubular carrier device.

2. The method of claim 1 further comprising pumping additional break-up treatment fluid through the tubular carrier prior to the flowing.

3. The method of claim 1 wherein the employing of the break-up treatment fluid alters a downhole condition to enhance the dissolution of the support system.

4. The method of claim 1 wherein the break-up treatment fluid comprises an acidic solution.

5. The method of claim 1 wherein the break-up treatment fluid is brine in the well.

6. A method of completing a well at an oilfield, the method comprising:

drilling a well;

placing a break-up treatment fluid into a well at a predetermined location;

outfitting the well with completions hardware having a perforating gun incorporated thereinto;

performing a perforating application at a carrier of the perforating gun; and producing a well fluid through the carrier of the gun.

7. The method of claim 6 wherein performing a perforating application comprises positioning the perforating gun at the predetermined location to allow the break-up treatment fluid to contact the carrier to substantially dissolve remaining components of the perforating gun.

8. The method of claim 7 wherein the introducing of the break-up treatment fluid takes place in a spotted fashion prior to the outfitting of the well with the completions hardware.

9. The method of claim 8 further comprising spotting one of a barrier fluid and a spacer fluid to one side of the introduced break-up treatment fluid for isolation thereof.

10. The method of claim 8 further comprising pumping additional break-up treatment fluid through the completions hardware to the carrier.

11. The method of claim 6 further comprising changing out equipment at a surface of the oilfield for production operations prior to the producing of the well fluid.

12. The method of claim 11 wherein the changing out of the equipment takes place over a period of time that is less than that taken for dissolution of components of the perforating gun by a break-up treatment fluid.

13. The method of claim 6 further comprising sealing the carrier closed to prevent further producing therethrough.

14. The method of claim 6 wherein the drilling of the well comprises drilling a rat-hole beyond a portion of the well to accommodate debris from the perforating gun, the rat-hole less than about 30% of a length of the gun.

15. A perforating gun comprising:

internal support structure to accommodate shaped charges within the carrier for a perforating application, the structure configured to deform upon the perforating application and for dissolving upon exposure to a break-up treatment fluid placed in a well prior to the perforating application; and a carrier for housing the internal support structure and configured to flow a fluid through an interior thereof after the dissolving.

16. The perforating gun of claim 15 wherein the internal support structure includes a component selected from a group consisting of a loading device, a booster support and a securing plate.

17. The perforating gun of claim 15 wherein the internal support structure includes a component comprised of a material selected from a group consisting of a degradable plastic, aluminum, magnesium and zinc.

18. The perforating gun of claim 17 wherein the plastic is selected from a group consisting of polylactide, polyvinyl alcohol, polyoxymethyline, expanded polystyrene foam, expanded polypropylene foam, polyurethane foam, polymethacrylimide foam, and polylactide foam.

19. The perforating gun of claim 15 wherein the internal support structure includes a propellant additive.

20. The perforating gun of claim 15 wherein the shaped charges include a casing comprised of one of zinc and a powdered metal.

* * * * *